US005285840A

United States Patent [19]

Hayashi et al.

[11] Patent Number: 5,285,840

[45] Date of Patent: Feb. 15, 1994

[54] METHOD AND APPARATUS FOR MANUFACTURING PISTON OF INTERNAL COMBUSTION ENGINE

[75] Inventors: Masamichi Hayashi; Yasuhiro Kawabata, both of Anjo; Shiro Machida, Okazaki; Takanori Kamiya, Anjo, all of Japan

[73] Assignee: Aisin Seiki Kabushiki Kaisha, Kariya, Japan

[21] Appl. No.: 952,349

[22] Filed: Sep. 28, 1992

[30] Foreign Application Priority Data

Sep. 30, 1991 [JP] Japan ..... 3-252330

[51] Int. Cl.[5] ..... B22D 19/02

[52] U.S. Cl. ..... 164/132; 164/346; 164/120; 164/112; 164/98; 164/320

[58] Field of Search ..... 164/98, 112, 120, 132, 164/137, 320, 332, 340, 346, DIG. 8; 29/888.04, 888.047, 888.05

[56] References Cited

U.S. PATENT DOCUMENTS

| | | | |
|---|---|---|---|
| 1,663,693 | 3/1928 | Feltes | 164/346 |
| 1,731,904 | 10/1929 | Nelson | 29/888.047 |
| 2,065,287 | 12/1936 | Nutt | 164/346 |
| 2,780,849 | 2/1957 | Berry | 164/346 |
| 2,965,938 | 12/1960 | Davis | 164/340 |
| 3,068,539 | 12/1962 | Wilcoxon | 164/320 |
| 3,387,646 | 6/1968 | Lauth | 164/120 |
| 4,570,693 | 2/1986 | Barlow | 164/320 |
| 4,890,543 | 1/1990 | Kudou et al. | 164/98 |
| 4,891,875 | 1/1990 | Soichi et al. | 164/132 |
| 5,074,352 | 12/1991 | Suzuki | 164/120 |

FOREIGN PATENT DOCUMENTS

| | | | |
|---|---|---|---|
| 1-71157 | 5/1989 | Japan . | |
| 3-26287 | 6/1991 | Japan . | |
| 0996088 | 2/1983 | U.S.S.R. | 164/320 |

*Primary Examiner*—Paula A. Bradley
*Assistant Examiner*—Erik R. Puknys
*Attorney, Agent, or Firm*—Oblon, Spivak, McClelland, Maier & Neustadt

[57] ABSTRACT

A piston is formed with a rib which is formed on a base portion and is formed with through holes which is formed in such manner that the core is in contact with a projection portions of a holding die.

8 Claims, 6 Drawing Sheets

METHOD AND APPARATUS FOR MANUFACTURING PISTON OF INTERNAL COMBUSTION ENGINE

BACKGROUND OF THE INVENTION

1. Field of the Invention

The present invention relates to a method and apparatus for manufacturing a piston of an internal combustion engine and more particularly to a method and apparatus for manufacturing a lightweight piston, which is high in rigidity, of an internal combustion engine.

2. Description of the Related Art

A conventional method for manufacturing a piston of an internal combustion engine, as shown in FIG. 8, is disclosed in Japanese Utility Model Publication No. 3(1991)-26287. In the above prior method, holding dies 72,73,74 and a punching core 75 are set at a first step, so as to form a space 71 therebetween. At a second step, melted aluminum alloy 77 is poured into the space 71, and is pressurized so as to thereby urge the punching core 75 downwardly. At a third step, the holding dies 72,73,74 and the punching core 75 are removed and a crude piston is cast. At a fourth step, the crude piston is finished.

In general, the piston comprises a land portion, a skirt portion and a cavity. In order to assure the stable or reliable movement of the piston in the internal combustion engine, a lower portion of the skirt portion is thickened and rigidity thereof is increased. The punching core 75 has an incline surface to easily remove the punching core 75 from the holding dies 72,73,74. Namely, an outside diameter of the top portion of the punching core 75 is smaller than an outside diameter of the base portion thereof. Thus, an upper portion of the skirt portion has to be more thickened. As a result, the piston becomes heavy and the smooth movement of the piston may be injured.

SUMMARY OF THE INVENTION

It is an object of the present invention to provide an improved method for manufacturing a piston which obviates the above mentioned various drawbacks.

It is another object of the present invention to provide an improved method for manufacturing a piston which is high in rigidity and low in the weight of the piston.

It is further object of the present invention to provide an improved apparatus for manufacturing a piston which is high in rigidity and low in the weight of the piston.

According to the present invention, method for manufacturing a piston of an internal combustion engine comprises the steps of forming a space by a pair of symmetrically divided holding dies and a core, the holding dies having projection portions, which is in contact with the core, to form through holes in a skirt portion of the piston and the core having a depression to form a rib on a base portion of the piston, pouring a melted aluminum alloy into the space removing the holding dies and the core, and finishing the piston.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
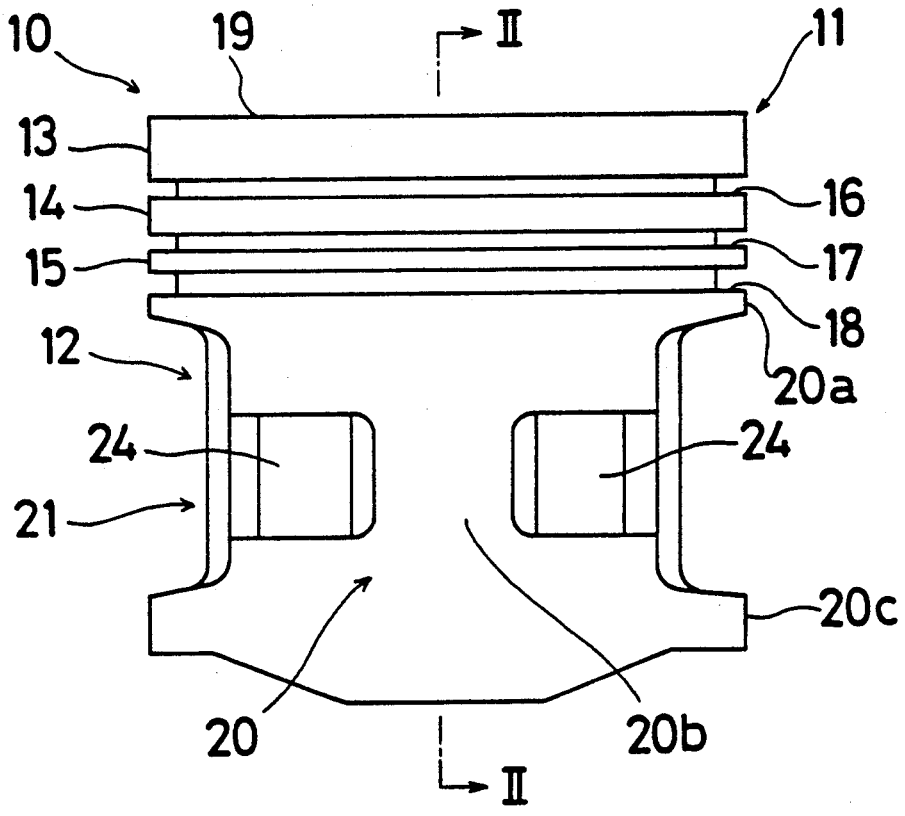
FIG. 1 is a side view of a piston manufactured according to the present invention.
Figure 2:
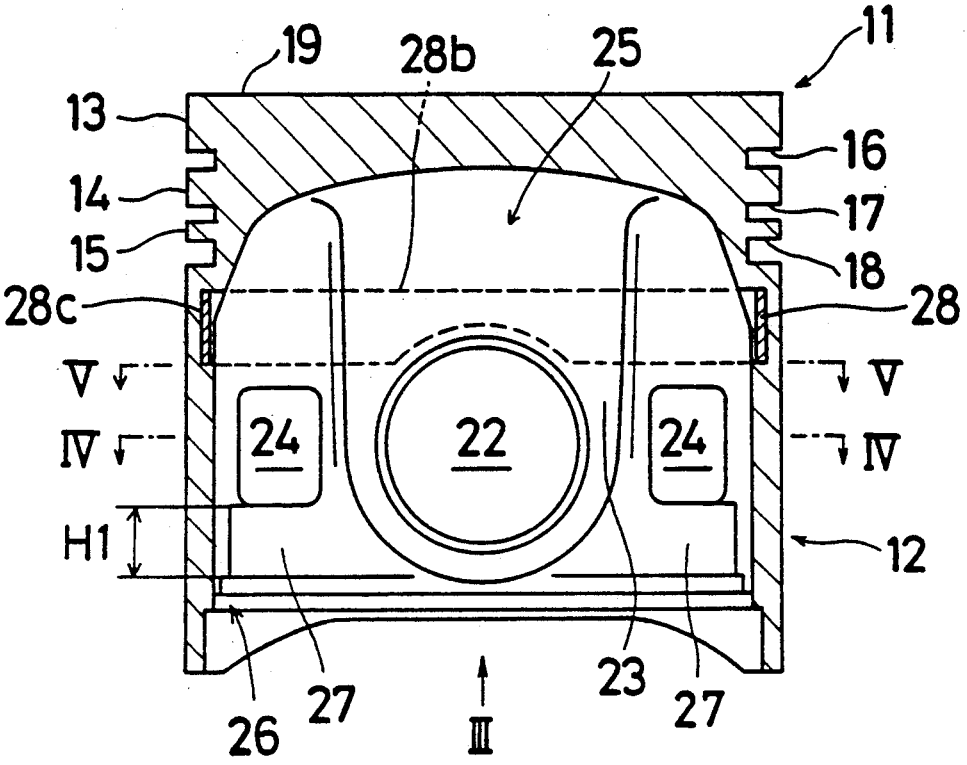
FIG. 2 is a cross-sectional view of the piston taken along the line II—II in FIG. 1.
Figure 3:
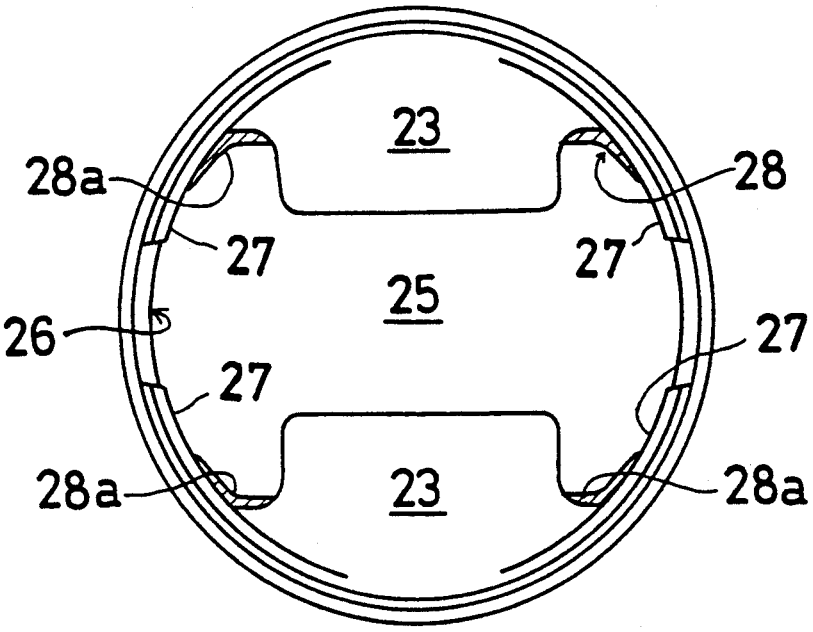
FIG. 3 is a bottom view of the piston shown in FIG. 2.
Figure 4:
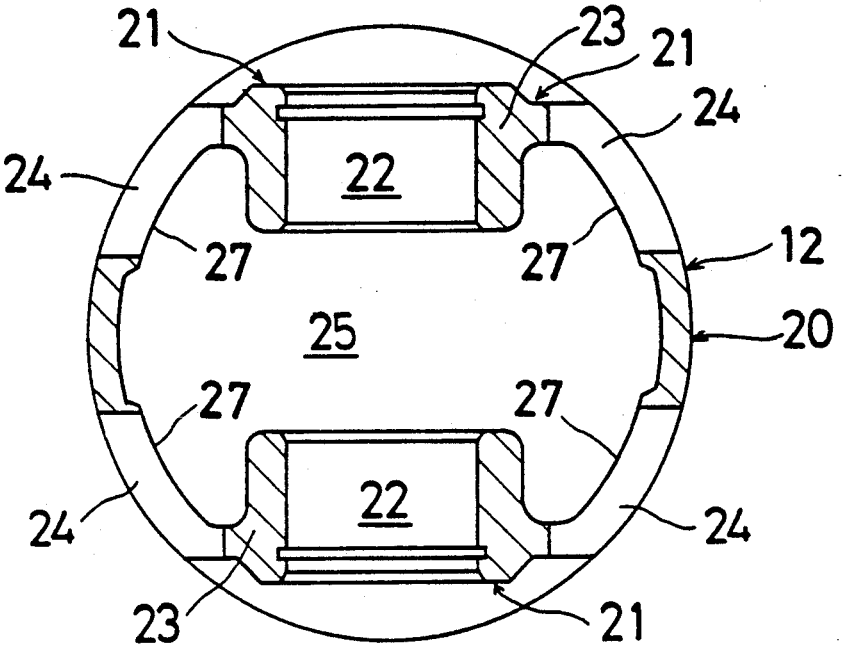
FIG. 4 is a cross-sectional view of the piston taken along the line IV—IV in FIG. 2.
Figure 5:
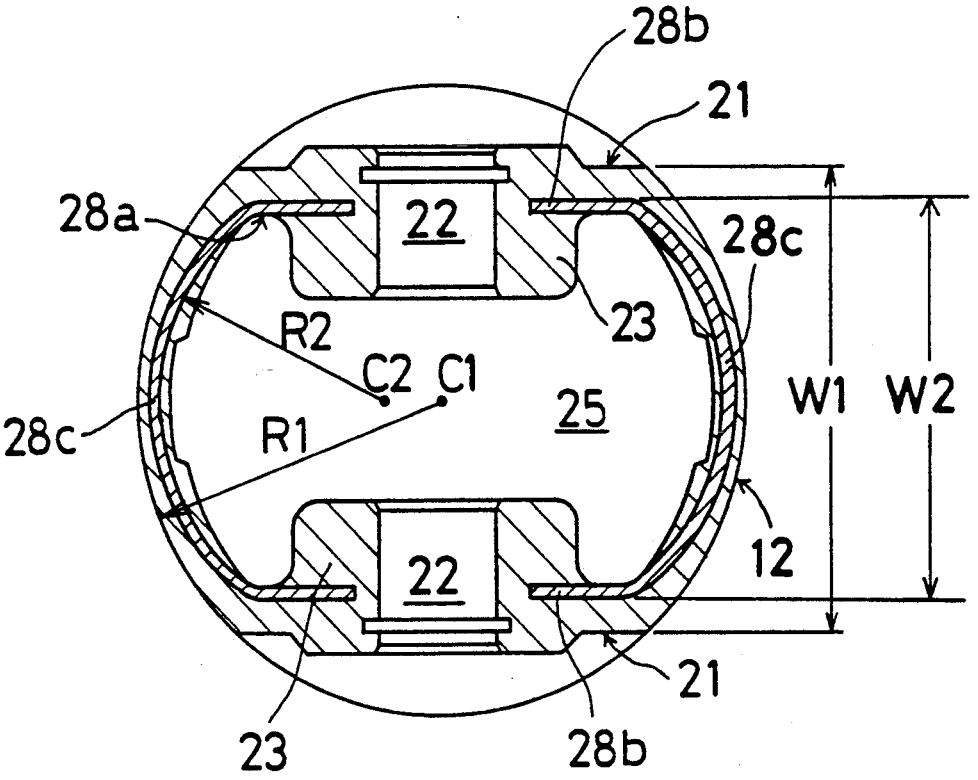
FIG. 5 is a cross-sectional view of the piston taken along the line V—V in FIG. 2.

Referring to FIGS. 1 to 5, the reference numeral 10 indicates a piston 10 manufactured according to the present invention. The piston 10 comprises a land portion 11 with a top surface 19 and a skirt portion 12. A land 13, a ring groove 16, a land 14, a ring groove 17, a land 15 and a ring groove 18 are formed in the land portion 11 in turn. Piston-rings (not shown) inserted into the ring grooves 16,17 operate as compression rings and a piston-ring (not shown) inserted into the ring groove 18 operates as oil-sealing ring. It is noted that the number of the ring grooves and piston-rings may be changed if necessary. A sliding surface 20 and non-sliding portions 21 are formed in the skirt portion 12 respectively. The sliding surface 20 slides on an inner surface (not shown) of a cylinder (not shown) of an internal combustion engine (not shown) and comprises a shoulder portion 20*a*, a center portion 20*b* and an under portion 20*c*. Pin holes 22 are formed in the non-sliding portions 21. Pin-bosses 23 are formed around the corresponding pin holes 22 respectively. Further, through holes 24 are formed in the sliding surface 20 and in the non-sliding portions 21, and at both sides of pin holes 22. A cavity 25 is formed in the piston 10. A base portion 26 is formed at lower portion in the cavity 25. Four ribs 27 are separately formed on the base portion 26 in the circumferential direction. The height of each rib 27 is shown by H1 in FIG. 2. A strut 28 is cast into an upper portion of the skirt portion 12 and comprises a pair of parallel straight portions 28*b* and a pair of curved portions 28*c*. Corner portions 28*a* of the strut 28 are extended into the cavity 25. A radius R1 of the piston 10 is larger than a radius R2 of each of the curved portions 28*c* of the strut 28. A center C2 of the radius R2 is located outside of the center C1 of the radius R1. Therefore, each of the curved portions 28*c* is positioned as close to the sliding surface 20 as possible. Further, a width W2 between the straight portions 28*b* can be narrow and a width W1 between the non-sliding portions 21 can be also narrow. As a result, it is possible to reduce the width W1 in the range of 65% to 80% of the diameter of the piston 10. The reduction of the width W1 can provide a well-balanced piston having an ideal relation between the weight and the rigidity.

Figure 6:
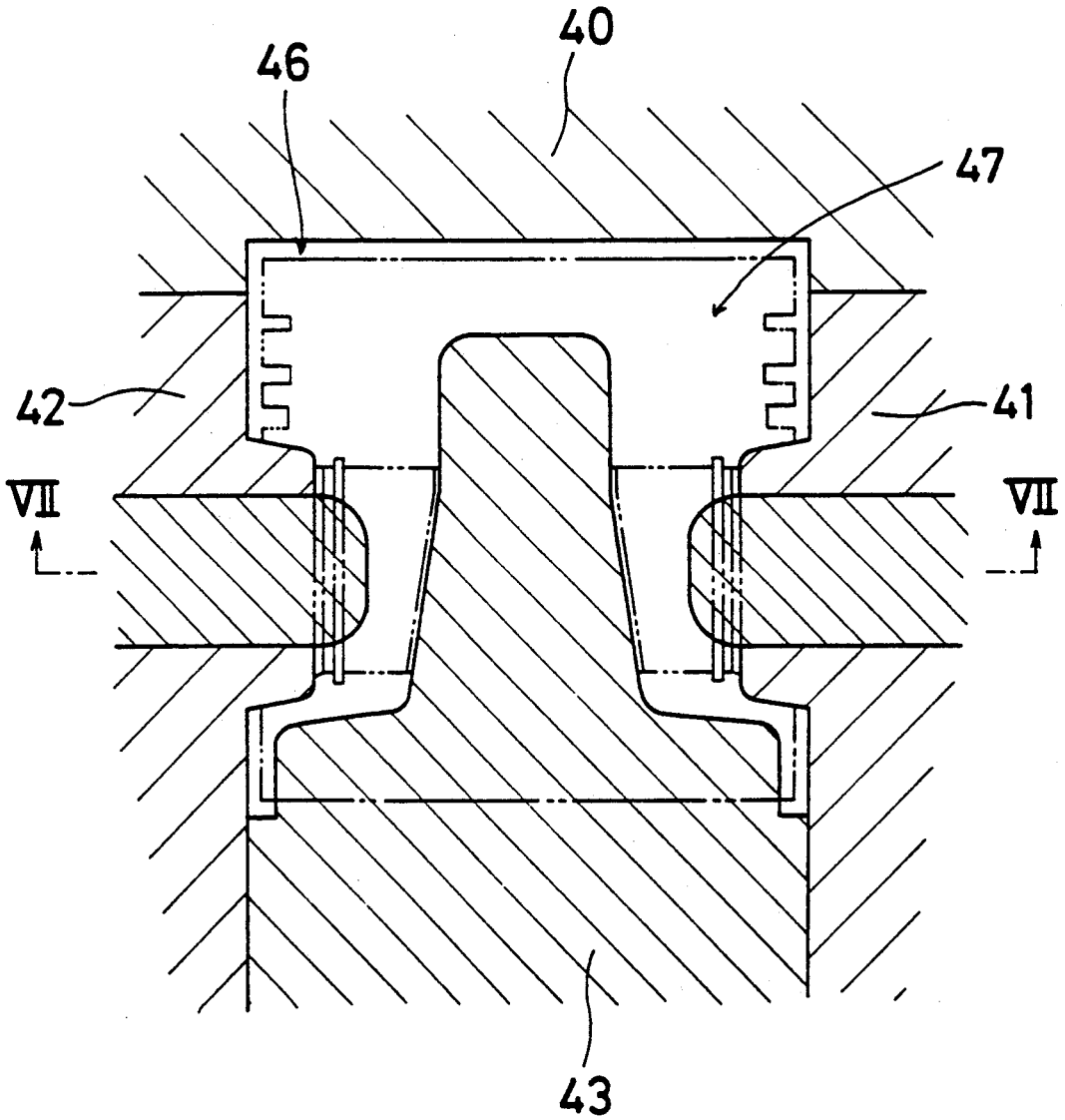
FIG. 6 is a cross-sectional view of the piston showing the step of pouring a melted aluminum alloy into the space between the dies.
Figure 7:
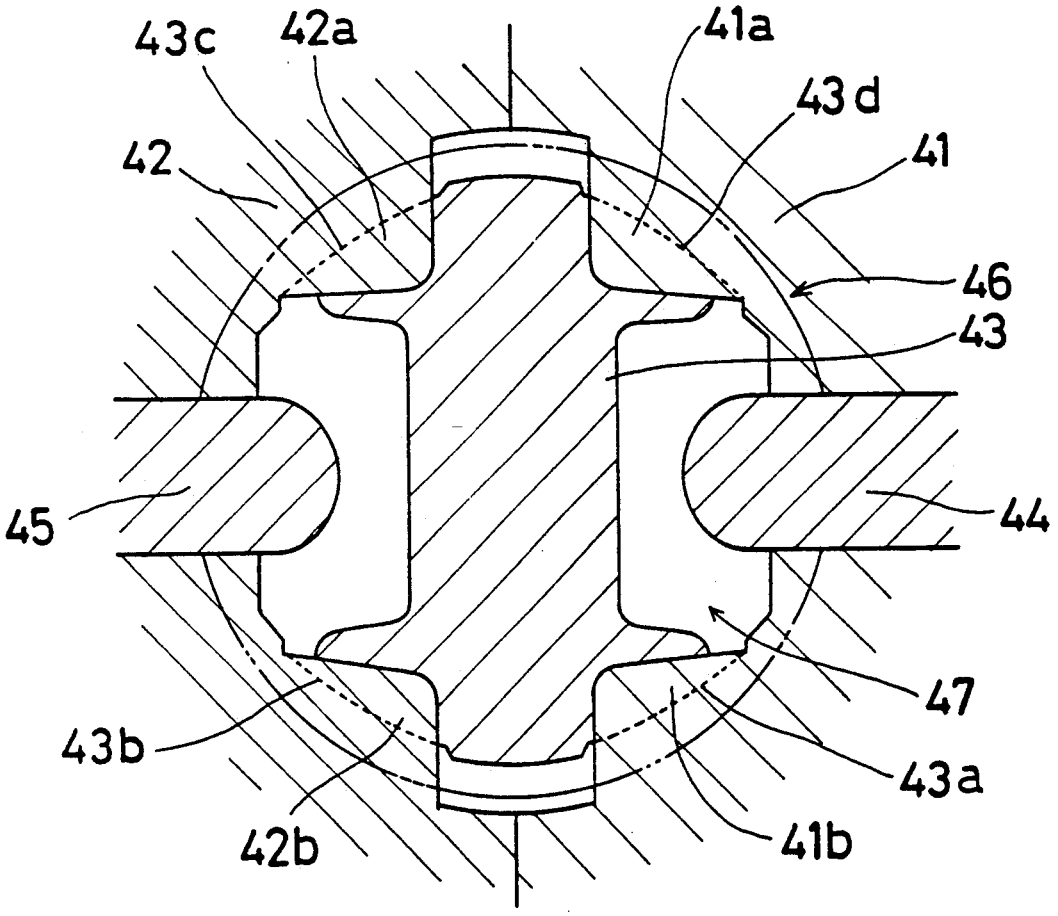
FIG. 7 is a cross-sectional view of the piston taken along the line VII—VII in FIG. 6.
Figure 8:
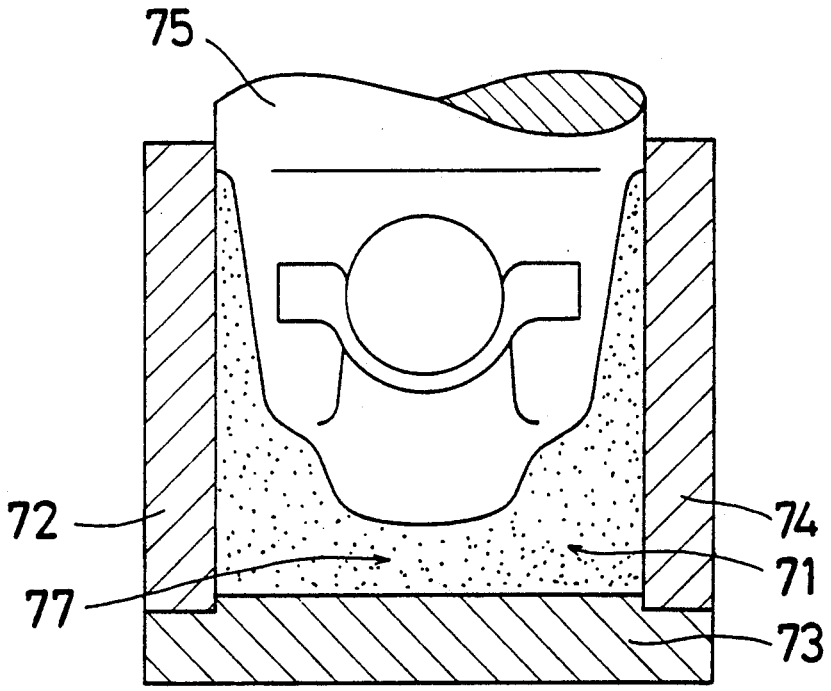
Fig. 8 (PRIOR ART)
FIG. 8 is a cross-sectional view similar to FIG. 6, but showing a conventional manufacturing method.

Referring now to FIGS. 6 and 7, a method for manufacturing a piston according to the invention is described:

First, a holding die 40, a pair of symmetrically divided holding dies 41,42 having projection portions **41*a*,41*b*,42*a*,42*b*, a core 43, a pair of pins 44,45, the strut 28 and a melted aluminum alloy are prepared. The core 43 has four depression portions 43*a*,43*b*,43*c*,43*d* to form the ribs 27. At a first step, the holding die 40 and the holding dies 41,42 are set so as to form a space 47 therein. At a second step, the core 43 with the strut 28 thereon is set into the space 47 so as to bring the core 43 into contact with the projection portions 41*a*,41*b*,-42*a*,42*b* to form the through holes 24. The pins 44,45 are located in the holding dies 41,42 and projected into the space 47. It is noted that the pins 44,45 are projected into a portion which the pin holes 22 are to be formed in the space 47. At a third step, a melted aluminum alloy is poured into the space 47. The pins 44,45 are further projected into the space 47 to pressurize the poured aluminum alloy. Numeral 46 shows the outline of the piston 10. At a fourth step, the holding dies 41,42 are removed in horizontal direction and the core 43** is removed in vertical direction with respect to the piston. Thus, a crude piston is cast. At the final or fifth step, the crude piston is finished by cutting.

Obviously, numerous modifications and variations of the present invention are possible in light of the above teachings. It is therefore to be understood that within the scope of the appended claims, the invention may be practiced otherwise than as specifically described herein.

We claim:

1. A method for manufacturing a piston of an internal combustion engine comprising the steps of:

forming a space by setting a pair of symmetrically divided holding dies having projection portions and a core being in contact with the projection portions to form through holes in a skirt portion of the piston, the core having a depression to form a rib on a base portion of the piston;

setting a strut on the core to cast the strut into the skirt portion of the piston before forming the space, the strut having a pair of straight portions and a pair of curved portions, wherein a radius of the piston is larger than each of radii of the curved portions, and wherein a center of each of the radii of the curved portions is located outside of a center of the piston;

pouring a melted aluminum alloy into the space;

removing the holding dies and the core; and finishing the piston.

2. A method for manufacturing a piston of an internal combustion engine as set forth in claim 1 further comprising the step of:

pressuring the poured aluminum alloy by projecting a pair of pins into the space after pouring the melted aluminum alloy into the space.

3. An apparatus for manufacturing a piston of an internal combustion engine comprising:

a pair of symmetrically divided holding dies forming a space therebetween where a melted aluminum alloy is poured, the holding dies having projection portions; and a core disposed in the space between the pair of holding dies to be in contact with the projection portions thereof to form through holes in a skirt portion of the piston, the core having a depression to form a rib on a base portion of the piston, wherein a strut is set on the core, the strut having a pair of straight portions and a pair of curved portions wherein a radius of the piston is larger than each of radii of the curved portions and a center of each of the radii of the curved portions is located outside of a center of the piston.

4. An apparatus for manufacturing a piston of an internal combustion engine as set forth in claim 3 further comprising:

a pin located in each holding die being projected into the space to pressurize the poured aluminum alloy.

5. A method for manufacturing a piston of an internal combustion engine, said piston including pin bosses, comprising the steps of:

forming a space by setting a core having a depression to form a rib on a lower portion of a skirt portion of the piston, said rib extending circumferentially and lying between said pin bosses and setting a pair of symmetrically divided holding dies, each of which comprises a projection portion so as to be contact with the core in order to form through holes at an upper portion of the rib of the skirt portion;

pouring a melted aluminum alloy into the space;

removing the holding dies and the core; and finishing the piston.

6. A method for manufacturing a piston of an internal combustion engine as set forth in claim 5 further comprising the step of:

pressuring the poured aluminum alloy by projecting a pair of pins into the space after pouring the melted aluminum alloy into the space.

7. An apparatus for manufacturing a piston of an internal combustion engine, said piston including pin bosses, and comprising:

a core having means for forming pin bosses and further having a depression to form a rib on a lower portion of a skirt portion of the piston, said rib extending circumferentially and lying between said pin bosses; and a pair of symmetrically divided holding dies, each of which comprises projection portion so as to be contact with the core in order to form through holes at an upper portion of the rib of the skirt portion.

8. An apparatus for manufacturing a piston of an internal combustion engine as set forth in claim 7 further comprising:

a pin located in each holding die being projected into the space to pressurize the poured aluminum alloy.

* * * * *